United States Patent [19]

Brown

[11] Patent Number: 5,073,063

[45] Date of Patent: Dec. 17, 1991

[54] WINDROW PAVING MACHINE AND METHOD OF PAVING

[75] Inventor: Robert L. Brown, Mattoon, Ill.

[73] Assignee: White Consolidated Industries, Inc., Cleveland, Ohio

[21] Appl. No.: 569,997

[22] Filed: Aug. 20, 1990

[51] Int. Cl.[5] ..... E01C 19/12; E01C 19/45

[52] U.S. Cl. ..... 404/101; 404/72

[58] Field of Search ..... 404/72, 101, 102, 108; 37/110

[56] References Cited

U.S. PATENT DOCUMENTS

| | | | |
|---|---|---|---|
| 3,678,817 | 7/1972 | Martenson et al. | 404/72 |
| 3,693,512 | 9/1972 | Smith | 404/101 |
| 3,893,780 | 7/1975 | Gutman et al. | 404/101 X |
| 4,317,642 | 3/1982 | Wirtgen | 404/72 |
| 4,708,519 | 11/1987 | Davin et al. | 404/101 |
| 4,934,864 | 6/1990 | Mauldin | 404/101 X |

*Primary Examiner*—Ramon S. Britts
*Assistant Examiner*—Nancy P. Connolly
*Attorney, Agent, or Firm*—Pearne, Gordon, McCoy & Granger

[57] ABSTRACT

A windrow-type paving machine movable along a windrow of paving material includes a loading conveyor operable to transfer the upper portion of the paving material within the windrow into a hopper. The remainder of the paving material remains on the roadway and passes through a tunnel formed in the paving machine to a lateral auger and screed which cooperate to spread and level the paving material. The machine provides a hopper which receives the upper portion of the paving material for subsequent delivery by a conveyor to the lateral auger and screed when insufficient paving material passes through the tunnel to produce the required paving. Agitator means are provided in the tunnel to break up lumps of paving material and the like before they reach the auger.

18 Claims, 4 Drawing Sheets

WINDROW PAVING MACHINE AND METHOD OF PAVING

BACKGROUND OF THE INVENTION

This invention relates generally to paving machines, such as asphalt paving machines, and more particularly to a novel and improved machine of the type in which the paving material is supplied in the form of a windrow.

PRIOR ART

At least two types of asphalt pavers are known. In a first type, disclosed for example in U.S. Pat. Nos. 3,584,547; 3,776,326; and 4,379,663 (all assigned to the assignee of the present invention), the machine provides a hopper which receives hot asphalt paving material directly from a dump truck. From the hopper, the material is carried by a conveyor to a location in front of a lateral auger. The auger distributes the paving material across the front of a screed. The paving material is leveled and smoothed by the screed. Usually, the screed only partially compresses the paving material, and subsequent compression or finishing is provided by heavy rolls which are driven back and forth over the paving material to complete the paving process. However, it is also known to provide screeds that produce substantial compression of the paving material. In such instance, however, the rate of movement of the paving machine is low.

In paving a continuous run of surface, it is desirable to avoid stopping of the paver, since such stopping may have an undesirable effect on the quality of the finished surface. Accordingly, it is conventional to feed raw hot asphalt to the hopper while the paver is moving, for example, from the rear of a truck moving ahead of the paver. In fact, the paver may be provided with push rollers at its front in order to enable it to provide the motive force for the truck while the truck is dumping asphalt into the hopper.

In such machine, continuous operation requires accurate timing of the movement and supply of trucks to ensure a continuous supply of paving material. Because of this timing requirement, there tends to be a practical limit in the amount of paving material that can be laid in a given period of time with such pavers.

A second known type of paver is referred to as a "windrow paver." In such pavers, the hot paving material is not dumped directly into the paver hopper. Instead, it is deposited as a windrow directly on the roadway ahead of the paver. Such windrow pavers provide a loader conveyor which picks up the paving material and loads it into a hopper. Thereafter, the paving material moves by a second conveyor to a location ahead of a lateral auger and screed in the same general manner described above in connection with the first type of paver.

Windrow pavers tend to reduce the problem of delivery timing of the supply of paving material, since the windrow can extend a substantial distance ahead of the paver. The windrow is often laid out in front of the paver by hopper trucks which attempt to deposit an amount of paving material in a given length of windrow equal to the amount of material required to pave a similar length of paving. Because the timing of delivery of the paving material is not as critical, it is possible to achieve higher paving speeds with windrow pavers. In the past, windrow pavers have been operated in a manner in which all of the paving material in the windrow is picked up from the roadway and deposited in the hopper. Therefore, in both prior systems described above, all of the paving material must pass through the hopper and conveyor systems.

SUMMARY OF THE INVENTION

This invention is directed to the provision of an improved windrow paver and to an improved method for using such paver.

Briefly stated, a paving machine is provided that is movable in a given direction on a surface to be paved. The paving machine has a hopper for receiving paving material, a lateral auger for distributing the paving material on the surface, conveyor means for directing paving material in the hopper to the auger, and a screed rearward of the auger for leveling the paving material distributed on the surface by the auger. In accordance with this invention, the paving machine further includes loading means mounted to direct paving material into the hopper from a windrow extending forwardly of the paving machine. The machine also includes a tunnel extending longitudinally under the paving machine from the front thereof to the auger. The height of the loading means is variable in order to enable paving material of a predetermined thickness to be directly passed through a tunnel under the paving machine to the auger.

The illustrated loading means comprises a conveyor extending at an angle to the road surface and adjustable to pick up paving material in a range of at least one inch to sixteen inches from the road surface. The tunnel preferably has a height of 12 to 18 inches.

In accordance with still another aspect of this invention, a method is provided for paving a surface with asphalt paving material employing a paving machine movable in a given direction on the surface. The paving machine has a hopper for receiving a portion of the paving material, an auger for distributing the paving material on the surface, and means for conveying paving material from the hopper to the auger. Further, the machine provides a screed for leveling paving material distributed by the auger.

In accordance with this invention, the paving material is deposited on the surface forwardly of the paving machine in the form of a windrow. A top portion of the deposited paving material is picked up from the windrow and directed to the hopper. The lower and remaining portion of the material in the windrow passes directly through a tunnel provided in the machine to the auger. Consequently, only a portion of the paving material must pass through the hopper conveyor system.

Further, the machine provides agitator means within the tunnel to remix the paving material as it passes through the tunnel. Such agitator also operates to break up any partially compacted lumps caused, for example, by trucks driving over the windrow ahead of the paver. Further in the illustrated embodiment, a powered mixer is provided at the exit of the hopper where the paving material passes from the hopper onto a conveyor which delivers the paving material from the hopper to the auger.

With this invention, only a small portion of the paving material need be handled by the loading conveyor, hopper and hopper conveyor system, since most of the material passes through the tunnel directly to the auger. In effect, the hopper functions as surge storage. For example, when a given length of windrow contains more paving material than is required for such given length of paving, the excess amount of paving material is picked up and temporarily stored in the hopper. On the other hand, when a given length of windrow contains less paving material than is required for such given length of paving, the shortage is made up by supplying paving material from the hopper.

It is desirable to provide a powered mixer at the exit end of the hopper to ensure that the paving material delivered from the hopper is thoroughly mixed.

With this invention, only a small portion of the paving material passes through the hopper system. Therefore, the equipment is subjected to much less wear and tear when compared to prior art machines in which all of the paving material was required to pass through the hopper and hopper conveyor system. Further, since most of the paving material passes directly through the tunnel to the auger and screed, there is less tendency for the material to be excessively cooled before the paving material is properly positioned on the roadway.

These and other aspects of this invention are illustrated in the accompanying drawings, and are more fully described in the following specification.

DETAILED DESCRIPTION OF THE DRAWINGS

Figure 1:
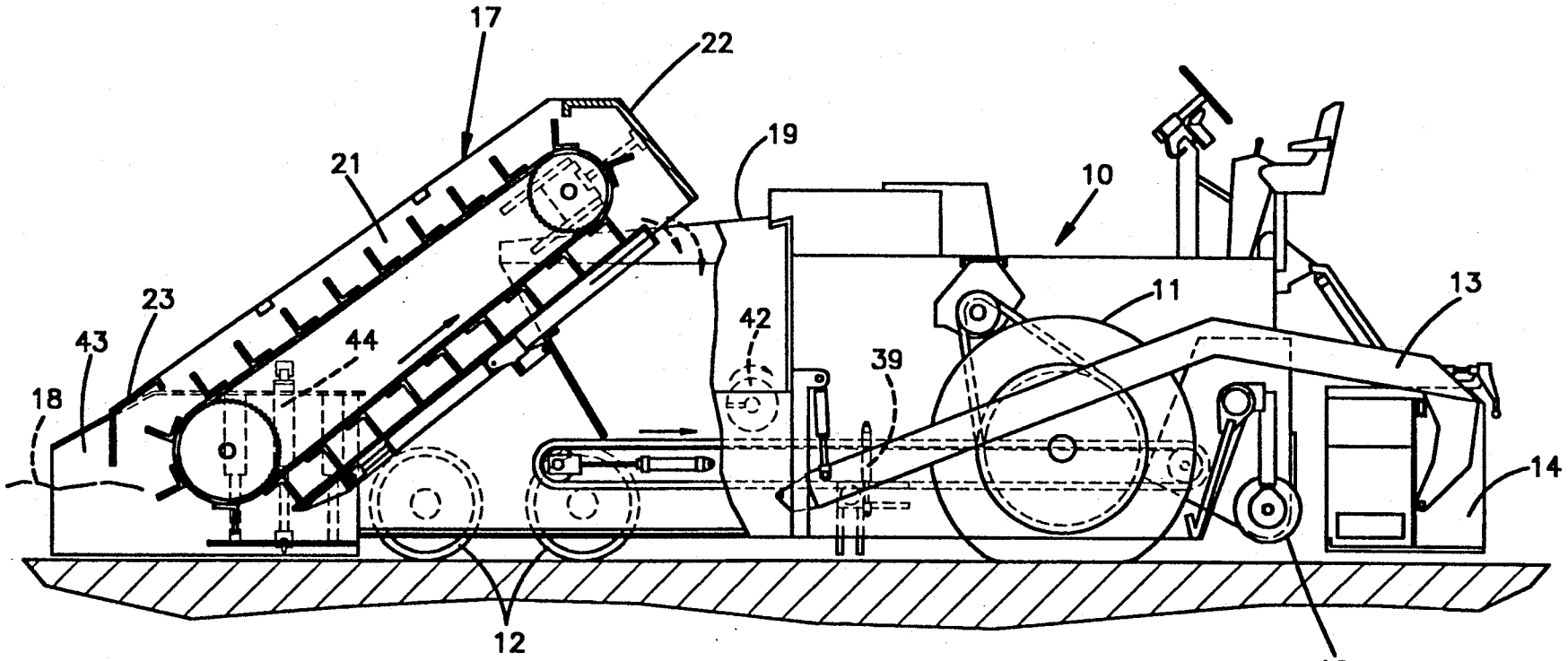
FIG. 1 is a side view, partially in section, of the paving machine in accordance with this invention.

As best illustrated in FIG. 1, the machine includes a body 10 supported adjacent its rearward end on a pair of large rear wheels 11. The forward end of the body 10 is supported by two pair of bogey wheels 12. Pivoted on opposite sides of the body are tow bars 13 which connect at their rearward ends to a screed 14.

Positioned immediately ahead of the screed 14 is a laterally extending powered auger 16 which functions to laterally distribute the paving material across the face of the screed. In the illustrated embodiment, the auger is hydraulically adjustable in height while the machine is in operation.

Figure 2:
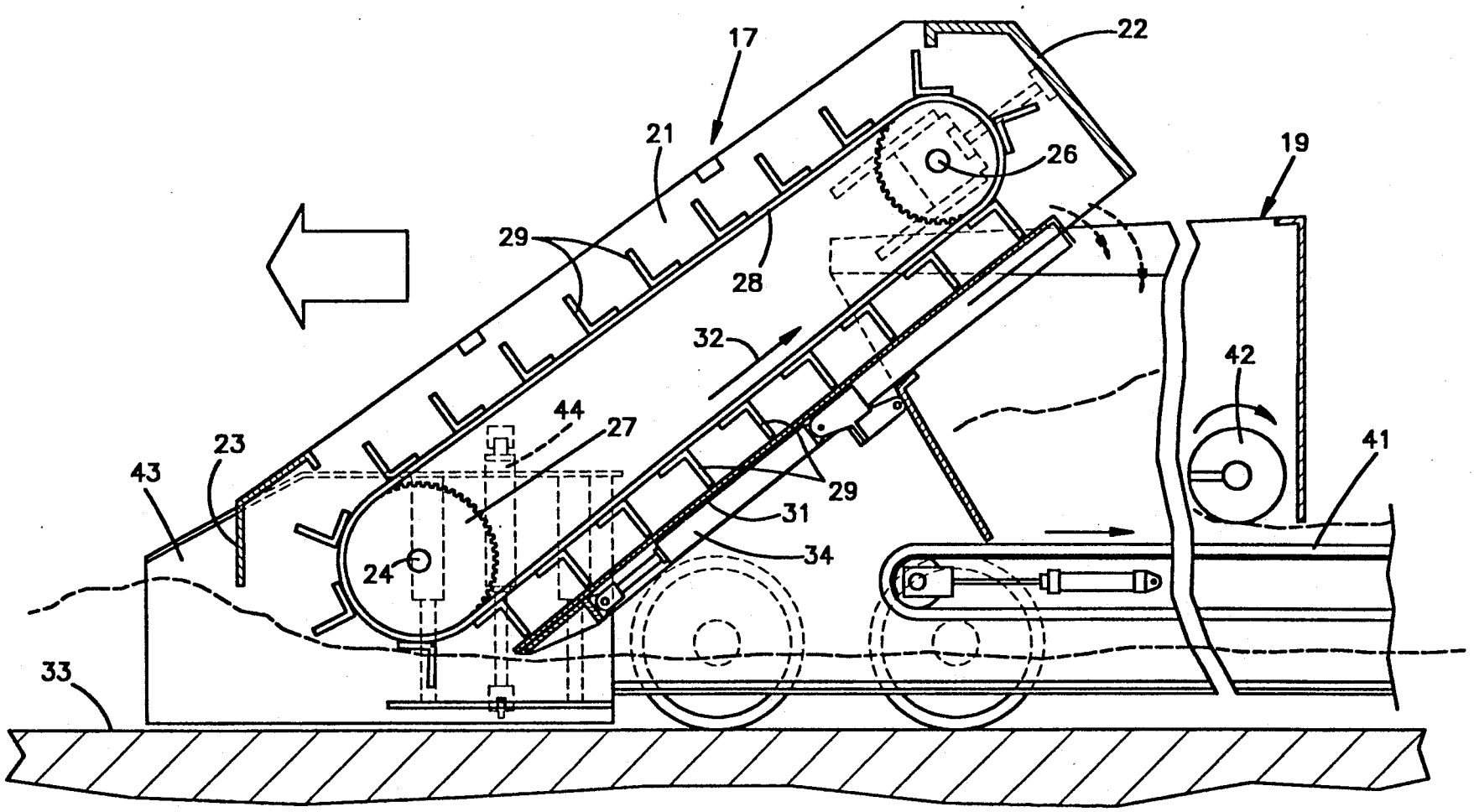
FIG. 2 is a cross-sectional view of the hopper loader along with the adjacent portions of the paver.
Figure 3:
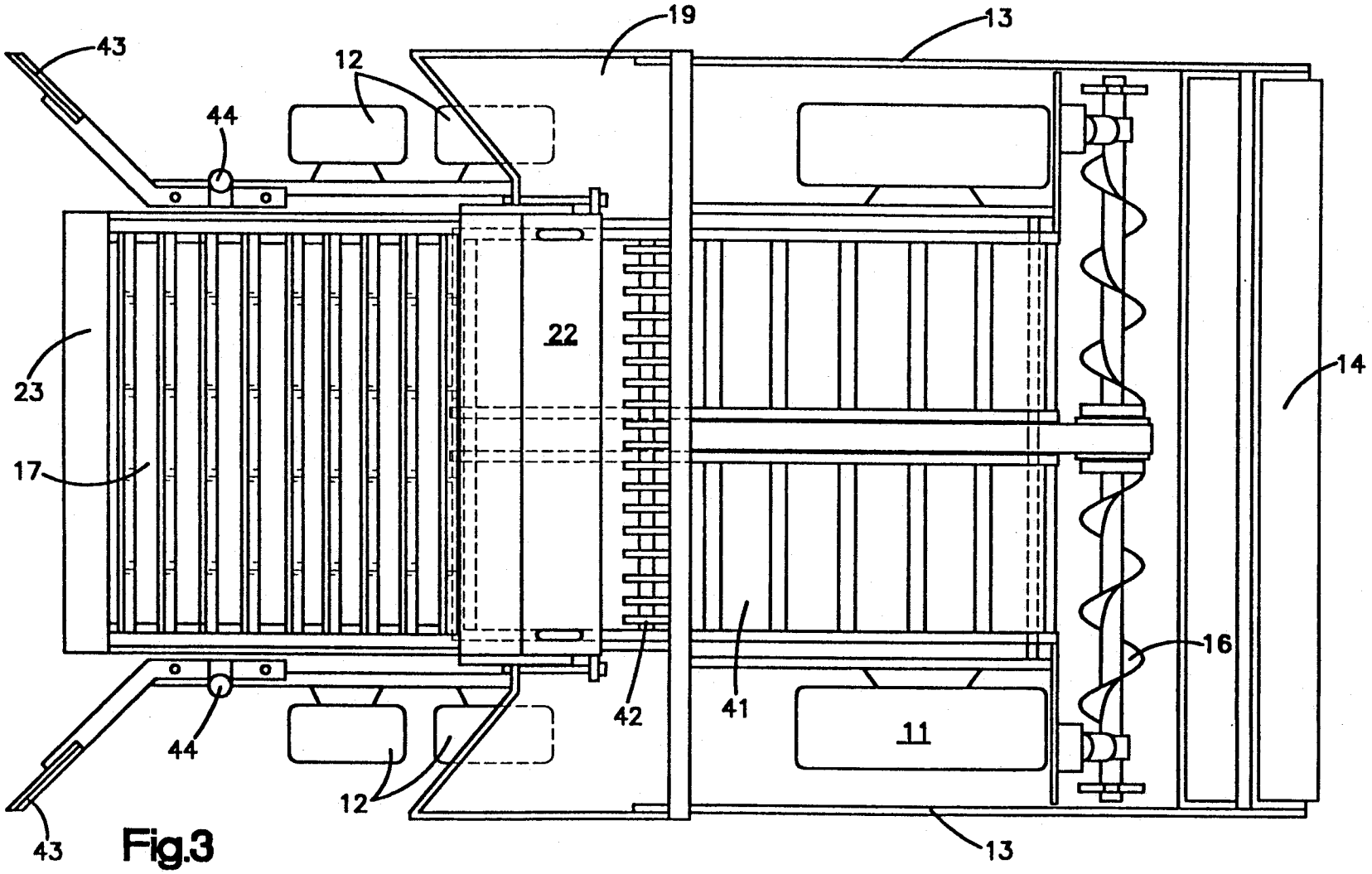
FIG. 3 is a plan view of the paver, with parts broken away for purposes of illustration.

Mounted on the forward end of the body 10 is a loader conveyor assembly 17 which functions to pick up a top portion of the paving material in a windrow 18 and deliver such paving material to a hopper 19. The loader conveyor 17 is mounted on the front of the body and includes a pair of side plates 21 joined together at their rear ends by a lateral rear plate 22 and at their front end by a front plate 23. The lower portion of the front end is open, as best illustrated in FIG. 2. Front and rear cross shafts 24 and 26 are rotatably mounted between the side plates. Each axle carries a pair of sprocket wheels 27. Conveyor chains 28 are mounted on and driven by the sprocket wheels 27. Lateral flights 29 are mounted on and carried along by the chains. As the chains are driven by the sprocket in an anticlockwise direction, as illustrated in FIG. 2, the flights 29 more up along a conveyor base plate 31 and transport a portion of the paving material from the windrow to the hopper 19, as indicated by the arrow 32.

The entire loader conveyor 17 is mounted at an angle with respect to the road bed 33, with its front end positioned close to the road bed and its upward rearward end above the hopper 19. The loader conveyor is mounted for height adjustment to permit the adjustment of the depth of the paving material left in the windrow below the portion which is picked up by the loader conveyor. The adjustment, in the illustrated embodiment, is provided by mounting the conveyor for movement relative to body 10 for inclined movement aligned with the length of the conveyor by means of a hydraulic actuator 34. By moving the entire conveyor assembly upwardly and rearwardly, the forward end is raised with respect to the road bed and greater depth of paving material remains on the road bed. Conversely, by moving the conveyor assembly forwardly and downwardly, the forward end of the conveyor is moved closer to the road bed and a greater amount of the paving material is loaded into the hopper, leaving less paving material on the road bed.

Figure 4:
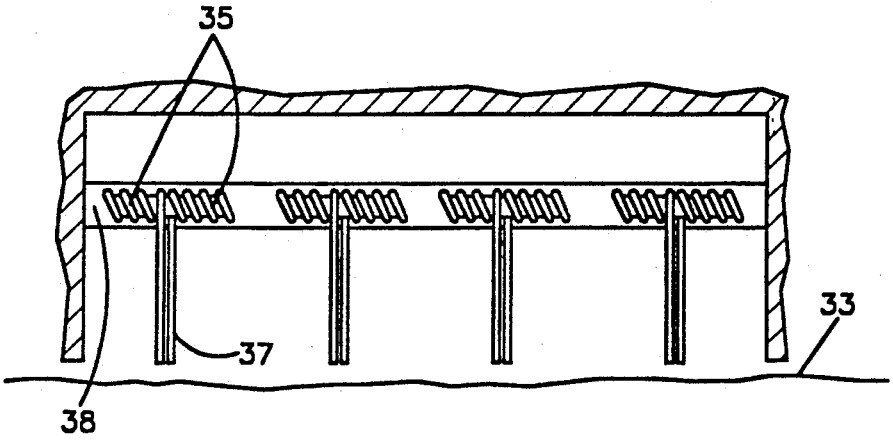
FIG. 4 illustrates the tunnel through which material passes directly to the auger and the agitator assembly mounted within the tunnel for movement between a retracted position and an extended operative position.
Figure 5:
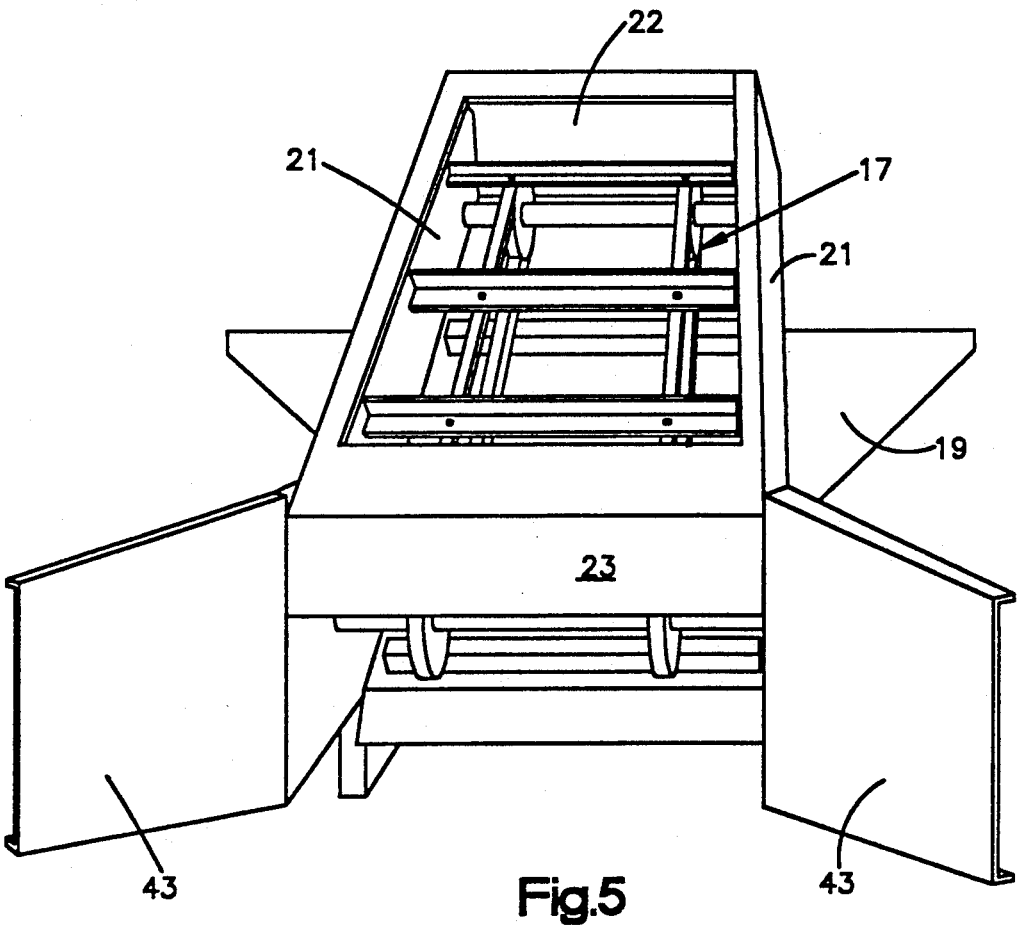
FIG. 5 is a schematic, perspective view of the front end of the paver, with portions broken away to better illustrate the invention.

The central portion of the body between the wheels provides a tunnel 36 having a top wall **36*a* and opposed side walls 36*b*, best illustrated in FIG. 4. This tunnel provides sufficient clearance so that the paving material left on the road bed by the loader conveyor can pass through the tunnel directly to the auger 16**. Therefore, such material does not have to pass through the hopper system during the paving operation. Preferably, the loader conveyor is adjustable through a range of about one inch to 16 inches from the road surface. The tunnel preferably has a height from 12 to 18 inches. In any event, the tunnel height is selected with respect to the adjustment range of the loader conveyor so that sufficient room is available in the tunnel to pass the paving material remaining on the road bed when the loader conveyor is adjusted to its maximum operating height.

Positioned within the tunnel are a plurality of agitator rods 37 which are cantilever-mounted at one end on an agitator support bar 38. In the illustrated embodiment, the rods are formed with a helical coil 35 at their mounted ends that gives them a spring support. The bar is pivotally mounted at its ends and extends laterally across the tunnel adjacent to the upper side thereof. A hydraulic actuator 39 is connected to rotate the support bar 38 through 90 degrees to move the agitator rods from a retracted, horizontally extending position to an operative, vertically extending position. These rods serve to perform remixing of the paving material passing through the tunnel 36 and also operate to break up clumps of paving material which may have been previously compressed, for example, by vehicles driving across the windrow ahead of the paver.

A hopper conveyor 41 is also mounted on the body above the tunnel, and extends from a position below the hopper 19 and a discharge position ahead of the auger 16. This conveyor operates to transport paving material from the hopper to the auger, where it is deposited on the material passing through the tunnel. In practice, the hopper functions primarily as a surge storage system. When the windrow contains more paving material for a given length of windrow than is required to produce a corresponding length of roadway, the loader conveyor picks up the excess material and deposits it in the hopper. Conversely, when the amount of material in the windrow is insufficient to produce a corresponding length of roadway, the deficiency is made up by delivering paving material from the hopper to the auger, where it is deposited upon the material passing through the tunnel.

Consequently, with a paver in accordance with the present invention, only a portion of the paving material is handled by the hopper and conveyor system. For example, if 85% of the paving material passes through the tunnel directly to the auger, only 15% of the paving material must be handled by the conveyor and hopper system. This reduction in the material which must be handled greatly reduces the wear and tear on the equipment, and promotes longer trouble-free service of the paver.

Since the amount of material passing through the hopper is not as great or necessarily continuous, it is desirable to put a powered agitator 42 in the hopper where the conveyor 41 removes paving material from the hopper.

In order to ensure that the paving material has a width no greater than the width of the tunnel, the machine is provided with a pair of angled wings 43 which are mounted adjacent to the forward end of the loading conveyor and ahead of the tunnel. These wings diverge outwardly in a forward direction, and are normally adjusted to move along the roadway surface. The wings direct the paving material of the windrow into alignment with the tunnel and the loading conveyor and also ensure that the width of the material passing through the tunnel does not exceed the width of the tunnel.

Hydraulic actuators 44 are provided to adjust the height and angle of the wings. In the illustrated embodiment, an engine drives one or more hydraulic pumps and operates the various actuators that control the various components of the machine. Since such hydraulic power and control systems are known to those skilled in the art, they have not been illustrated.

Preferably, the paver is operated so that at least about 10%, and preferably about 20–25%, of the paving material is picked up by the loader conveyor and passes through the hopper system.

Although the preferred embodiment of this invention has been shown and described, it should be understood that various modifications and rearrangements of the parts may be resorted to without departing from the scope of the invention as disclosed and claimed herein.

What is claimed is:

1. A paving machine for paving a roadway with paving material supplied in the form of an elongated windrow extending along said roadway, comprising a body assembly, means supporting said body assembly for movement along said roadway substantially in alignment with said windrow, leveler means on said body assembly operable to distribute and level said paving material, said machine providing powered means operable to separate an upper portion of said paving material from the lower portion thereof and to temporarily store said upper portion, said machine operating to move said leveler means along said lower portion to pave said roadway therewith, said power means operating to supply part of said upper portion when the volume of said lower portion is insufficient for the desired paving, said body assembly providing a tunnel having a top wall and opposed side walls through which said lower portion of said paving material passes to said leveler means.

2. A paving machine as set forth in claim 1, wherein said power means includes a hopper operable to temporarily store said upper portion of said paving material and providing sufficient surge capacity to compensate for variations in the volume of material in said windrow.

3. A paving machine as set forth in claim 1, wherein said leveling means includes a laterally extending powered auger and a screed.

4. A paving machine for paving a roadway with paving material supplied in the form of an elongated windrow extending along said roadway, comprising a body assembly, means supporting said body assembly for movement along said roadway substantially in alignment with said windrow, leveler means on said body assembly operable to distribute and level said paving material, said machine providing powered means operable to separate an upper portion of said paving material from the lower portion thereof and to temporarily store said upper portion, said machine operating to move said leveler means along said lower portion to pave said roadway therewith, said power means operating to supply part of said upper portion when the volume of said lower portion is insufficient for the desired paving, wherein said body assembly provides a tunnel through which said lower portion of said paving material passes to said leveler means, and wherein agitator means are provided within said tunnel operable to agitate said lower portion of said paving material and to break up lumps thereof.

5. In a paving machine that is movable in a given direction on a surface to be paved, the paving machine having a hopper for receiving paving material, an auger for distributing paving material on the surface, means for directing paving material in said hopper to said auger, and a screed rearward of said auger for leveling paving material distributed on said surface by said auger, the improvement wherein said paving machine further comprises loading means mounted to direct paving material into said hopper from said surface forwardly of said paving machine, a tunnel extending longitudinally under said paving machine from the front thereof to said auger, means for adjusting the height of said loading means to adjust the amount of paving material that passes through said tunnel under said paving machine to said auger.

6. The paving machine of claim 5, wherein said loading means is movably mounted on said paving machine.

7. The paving machine of claim 5, wherein said means for varying the height of said loading means includes means for slidably mounting said loading means to said machine.

8. The paving machine of claim 5 further comprising agitator means mounted in said tunnel for agitating paving material passing through said tunnel.

9. The paving machine of claim 5, wherein said loading means comprises a pair of parallel spaced-apart shaft means and an endless conveyor extending between said shaft means, said loading means being slidably mounted on said paving machine forwardly of said hopper with said shaft means defining a plane at an acute angle to said surface.

10. The paving machine of claim 9, wherein said angle is about 40 degrees.

11. The paving machine of claim 9, wherein said means for varying the height of said loading means comprises means for controlling the minimum height of the bottom of said conveyor to be at least as low as 1 inch and the maximum height of the bottom of said conveyor to be at least as high as 12 inches.

12. The paving machine of claim 9, wherein said means for varying the height of said loading means comprises means for controlling the minimum height of the bottom of the conveyor to be at least as low as 1 inch and the maximum height of the bottom of the conveyor to have a height from 12 to 18 inches.

13. The paving machine of claim 5, wherein said tunnel has a height of less than about 18 inches.

14. The paving machine of claim 5, wherein said means for varying the height of said loading means comprises means for controlling the height of said loading means to pick up from 20 to 25% of the paving material on said surface, whereby the remainder of the material remaining on the road surface passes through the tunnel.

15. In a paving machine that is movable in a given direction on a surface to be paved, the paving machine having a hopper for receiving paving material, an auger for distributing paving material on the surface, means for directing paving material in said hopper to said auger, and a screed rearward of said auger for leveling paving material distributed on said surface by said auger, the improvement wherein said paving machine further comprises conveyor means, means for mounting said conveyor means on the paving machine to extend at an acute angle to said surface for directing paving material into said hopper from said surface forwardly of said paving machine, and a tunnel extending longitudinally under said paving machine from the front thereof to said auger, said mounting means comprising means for varying the height of the bottom of said conveyor means from said surface to adjust the thickness of paving material passing under said conveyor means and through said tunnel to said auger.

16. The paving machine of claim 15 further comprising agitator means mounted in said tunnel for agitation of said paving material passing therethrough.

17. The paving machine of claim 16 further comprising means for retracting said agitator means from engagement with paving material in said tunnel.

18. A method for paving a surface with paving material, with a paving machine movable in a given direction on the surface and having a hopper for receiving paving material, an auger for distributing paving material on a surface, means for conveying paving material from the hopper to the auger, and a screed for leveling paving material distributed by said auger, said method comprising depositing paving material on said surface forwardly of said paving machine, picking up a first portion of said deposited paving material and directing it to said hopper whereby said picked up paving material is delivered to said auger by said conveying means, and allowing a second portion of said deposited paving material to pass directly under said paving machine to said auger, said second portion of said deposited paving material having a thickness of at least one inch, and picking up from 20-25% of said deposited paving material from said surface.

* * * * *